US006170421B1

(12) United States Patent
Ross

(10) Patent No.: US 6,170,421 B1
(45) Date of Patent: Jan. 9, 2001

(54) APPARATUS FOR SAILS

(75) Inventor: Gordon Ross, Glasgow (GB)

(73) Assignee: Powerfoil Limited, Glasgow (GB)

( * ) Notice: Under 35 U.S.C. 154(b), the term of this patent shall be extended for 0 days.

(21) Appl. No.: 09/223,188

(22) Filed: Dec. 30, 1998

(30) Foreign Application Priority Data

Jan. 5, 1998 (GB) ..... 9800021

(51) Int. Cl.[7] ..... B63H 9/04
(52) U.S. Cl. ..... 114/102.13; 114/102.22
(58) Field of Search ..... 114/39.12, 89, 114/90, 97, 98, 102.1, 102.13, 102.14, 102.22, 102.23, 102.24, 102.27, 102.29, 108, 112

(56) References Cited

U.S. PATENT DOCUMENTS 3,332,383 * 7/1967 Wright ..... 114/102.22
4,369,724 * 1/1983 Weiss ..... 114/102.22
4,699,073 * 10/1987 Farneti ..... 114/102.25
5,271,349 * 12/1993 Magrini ..... 114/105
5,423,276 * 6/1995 Nishimura ..... 114/98
5,799,601 * 9/1998 Peay ..... 114/102.27

* cited by examiner

*Primary Examiner*—Stephen Avila
(74) *Attorney, Agent, or Firm*—Fleshner & Kim, LLP

(57) ABSTRACT

A sail envelope has an internal mast or spar and one or more profiles (1) that is or are free to rotate relative to the longitudinal axis of the mast. Each profile has an outer edge in the form of a symmetrical aerofoil upon which the inner sides of the external sail surfaces bear.

5 Claims, 5 Drawing Sheets

APPARATUS FOR SAILS

This invention relates to apparatus used in the construction of a sail envelope for use on various types of sailing craft, including wind surfers. The invention finds a particular application in relation to sails which are made in or can be adjusted to adapt to the form of an aerofoil. Such sails are typically provided with two spaced, external sail surfaces that extend from a sail mast.

The construction of sails of such type has been wrought with difficulty. Design requirements are demanding as the sail must be lightweight but able to withstand high or gusty winds, and substantial impact loads in the event of collision or the like.

One particular problem that must be overcome is the design of the junction or interaction of the sail and the mast. The problem is more challenging when the external sail surfaces may alternate between serving as a leeward and a windward surface. Where the sail functions in this manner, the aerofoil or sail envelope ideally changes in cross-section, and thus the junction or interaction between the sail envelope and the mast should allow for this requirement.

It is felt that such junction designs have heretofore been less than satisfactory and there is a need to provide a better design of junction between a sail mast and a sail envelope for use on sailing craft.

For example, one design suggested in the past has involved positioning the mast externally of the sail envelope. However, this is undesirable as the mast, being forward of the sail envelope, mitigates the advantage of the aerofoil design.

In U.S. Pat. No. 4,699,073 there is disclosed a double surface sail wherein the sail cloth directly contacts and wraps around the mast. The cloth is able to slide around the mast to enable it to adopt alternative aerofoil profiles. The Patent teaches the use of a tubular or conventional mast, meaning that the leading edge of the sail maintains a constant circular convex shape, regardless of the aerofoil adopted by the sail envelope. In the present invention it is recognised that it would be advantageous to provide a junction between the sail envelope and the mast which enables the leading edge of the sail to change shape in a manner which optimises or at least improves the aerofoil efficiency.

However, it is recognised that it is not entirely satisfactory to profile the mast in a more aerodynamic shape, as to benefit from doing so would require the mast to rotate around its longitudinal axis in accordance with the relative direction of the wind to the craft. This would necessitate undue torsion or strain on the mast or require a complex mounting mechanism between the mast and the board of the craft.

According to the present invention there is provided a profile for use in a sail, the sail having a mast and two spaced external sail surfaces, wherein, in use, the profile is free to rotate relative to the longitudinal axis of the mast and has an outer edge upon which the inner sides of the external sail surfaces bear.

Typically the profile contacts or abuts against the mast. Preferably, the outer edge of the profile is in the form of a symmetrical aerofoil and comprises two moulded plastic components hinged together at a pivot or joint positioned forward of the mast, in use. The joint, in a preferred design, may be adapted to be dismantled without damaging the components or profile generally.

Preferably, each component is of substantially identical design and dimension.

The outer edge of the profile may be, desirably, flanged to provide greater support to the inside faces of the external sail surfaces.

The profile preferably includes means for making a mechanical connection to sail battens.

Also according to the invention there is provided a sail having a mast or spar and two spaced external surfaces capable of adopting the shape of an aerofoil, the sail further comprising a plurality of profiles as described herein.

Yet further, according to the present invention there is provided a sail having a mast or spar and two spaced external sail surfaces forming a sail envelope, wherein the mast or spar is positioned substantially within the sail envelope, and wherein the sail surfaces are held away from contact from the mast or spar by one or more profiles, wherein the profiles are shaped in the form of an aerofoil.

Preferably, the one or more profiles are free to rotate relative to the longitudinal axis of the mast or spar.

Typically, the profile and sail are for use with a windsurfer.

An example embodiment of the invention will now be described by way of example only with reference to the accompanying drawings, in which.

Figure 1:
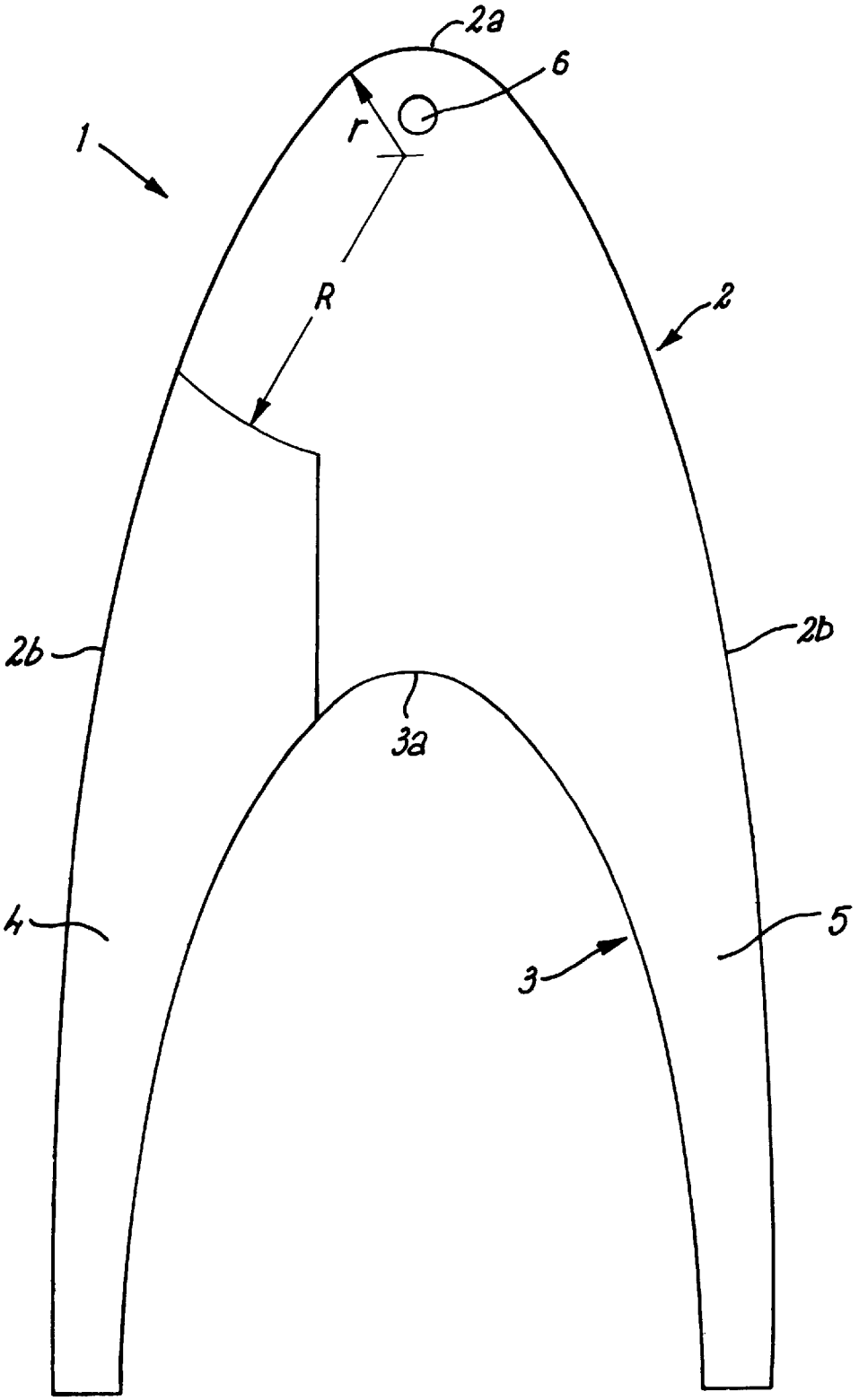
FIG. 1 shows a plan view of a profile in accordance with the invention.

Referring firstly to FIG. 1, a profile, generally described at 1, has an outer edge 2 and an inner edge 3. The front portion 2*a* of the outer edge 2 is of semicircular design, having a circumference defined by the radius "r". The surfaces 2*b* provide an aerofoil profile and are designed in accordance with general dynamic principles. Example dimensions are given below.

The profile 1 is made of two substantially identical components 4,5 which are pivotally connected at the joint 6. Each component 4,5 is made from a moulded plastics material and as the components are substantially identical, it may be possible to use the same mould to produce each component. Example materials considered to be appropriate for the components include high density polypropylene and high density polyethylene.

The joint 6 is of a snap-fit or press-fit construction and its pivoting function enables the profile to open out, with each component 4,5 extending in a diametrically opposed direction. This allows for a simple and efficient assembly of a double surface sail, as elaborated upon herein below.

In use, the mast (not shown) bears upon the inner edge 3, and more specifically, the forward portion 3*a* of the inner edge 3. In this vicinity, the inner edge 3 is shaped to allow for the profile to swivel around the mast such that the profile 1 can be pointed, in use, in a direction which most aptly creates an efficient aerofoil from the sail surfaces.

It should be noted that the invention does not therefore require any torsion to be imposed to the mast by the load on the sail. It follows that the mast itself does not require to twist in order to improve the efficiency of the sail aerofoil or in consequence to loading. This is merely achieved by the rotation of the profile 1 and sail around the mast.

Desirably, a sail would comprise several profiles 1 spaced along the mast. There may be a profile for each set of battens. An advantage of the invention is that the profiles provide structural support to the mast, in use.

Figure 2:
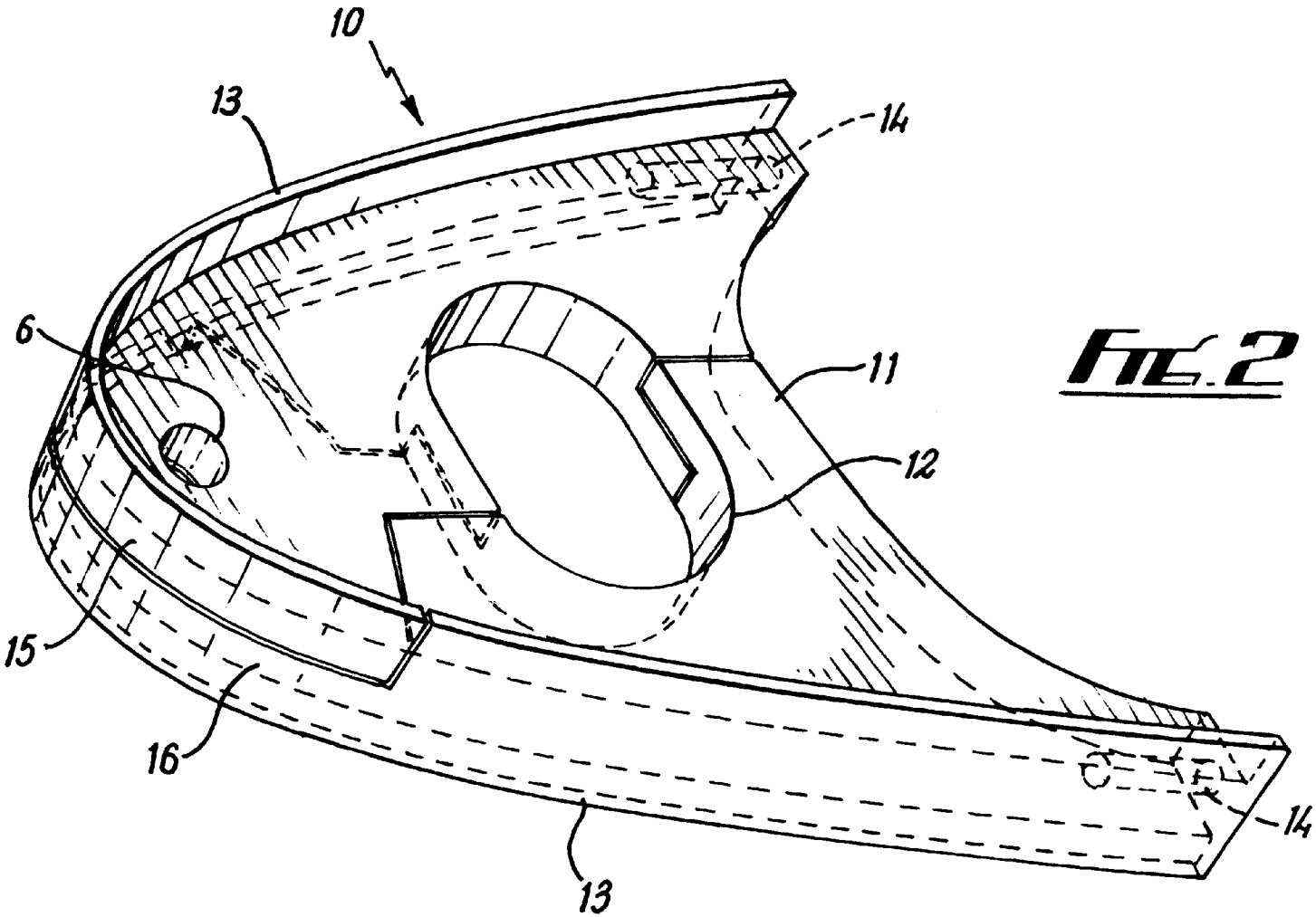
FIG. 2 shows a pictorial view of a second profile in accordance with the invention.

Further details of a profile can be seen from FIG. 2 which illustrates a perspective view of a profile, generally described at 10, of similar but alternative design. It may be noted for example that in the embodiment of FIG. 2, the profile 10 includes a strut 11 which closes behind the mast; the mast being positionable, in use, in the aperture 12 which forms when the profile 10 is closed as shown. The aperture 12 provides a loose fit for the mast and, in particular, is broader than the circumference of the mast. This permits the profile to slide from side to side, balancing longitudinal sail tension as the sail is loaded on each tack.

Also in the profile 10 it may be seen that the outer edge 13 is provided with a flange. The flange reduces any possibility of the profile 10 from tearing or otherwise piercing the sail surface and provides a more substantial supporting surface for shaping and supporting the sail aerofoil.

At the trailing end of the profile 10 are provided two bores 14 which are sized to receive the sail battens. A bore 14 is provided on each side of the mast to receive a batten for a respective sail surface or panel. The battens are used to support the sail surfaces, downstream from the luff of the sail forming the remaining portion of the aerofoil cross-section.

The joint 6 includes a through hole to permit the fitting of an internal tension cable or cord.

The lines of hidden detail in FIG. 2 show how each component 15,16 in the profile 10 fit together to form a symmetrical profile. The only difference between the components 15,16 is in the joint, where component 15 comprises a male joining member, while component 16 comprises a corresponding female joining member.

Figure 3:
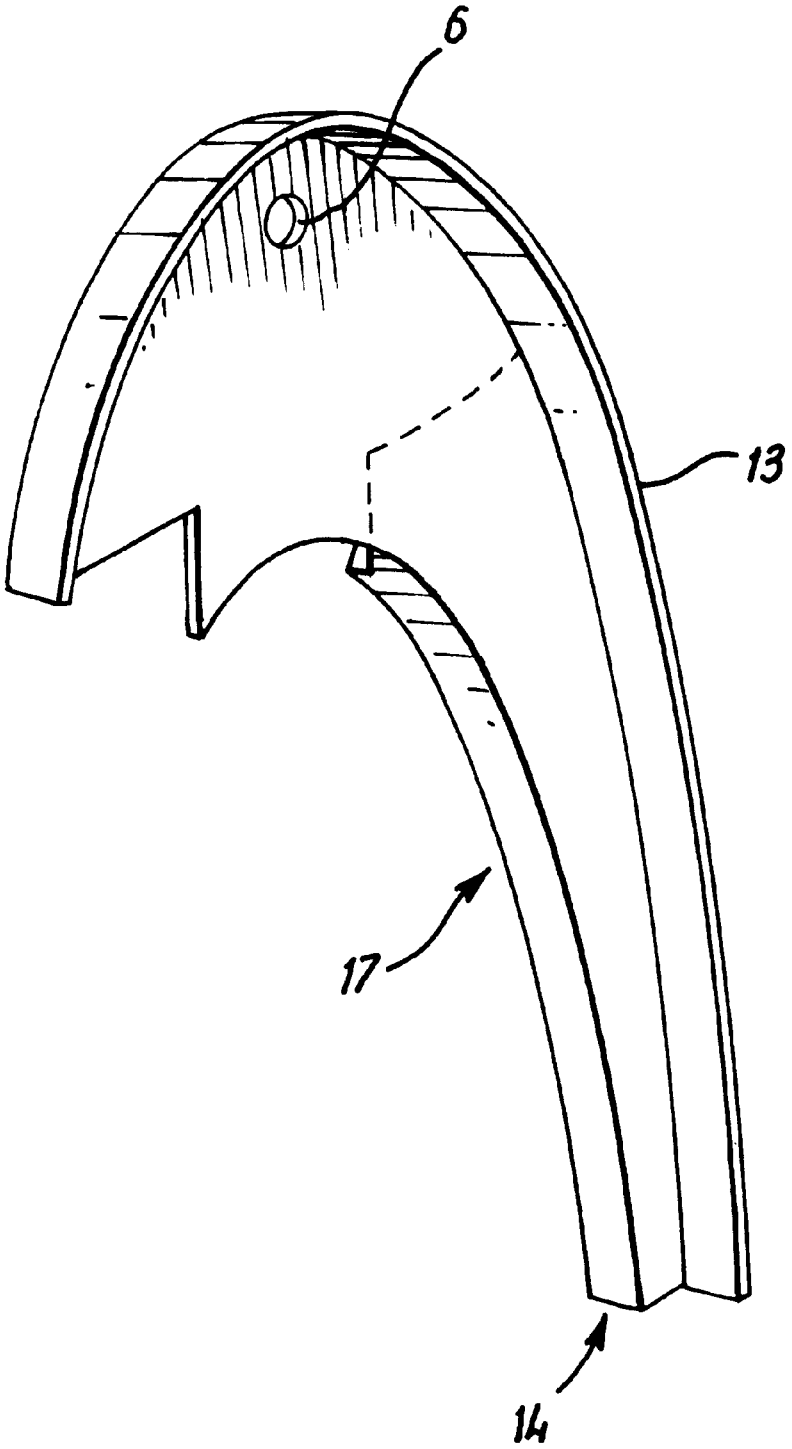
FIG. 3 illustrates a single component that forms one half of a profile in accordance with the invention.

The shape and design of a single component 17 is illustrated in FIG. 3.

Figure 4:
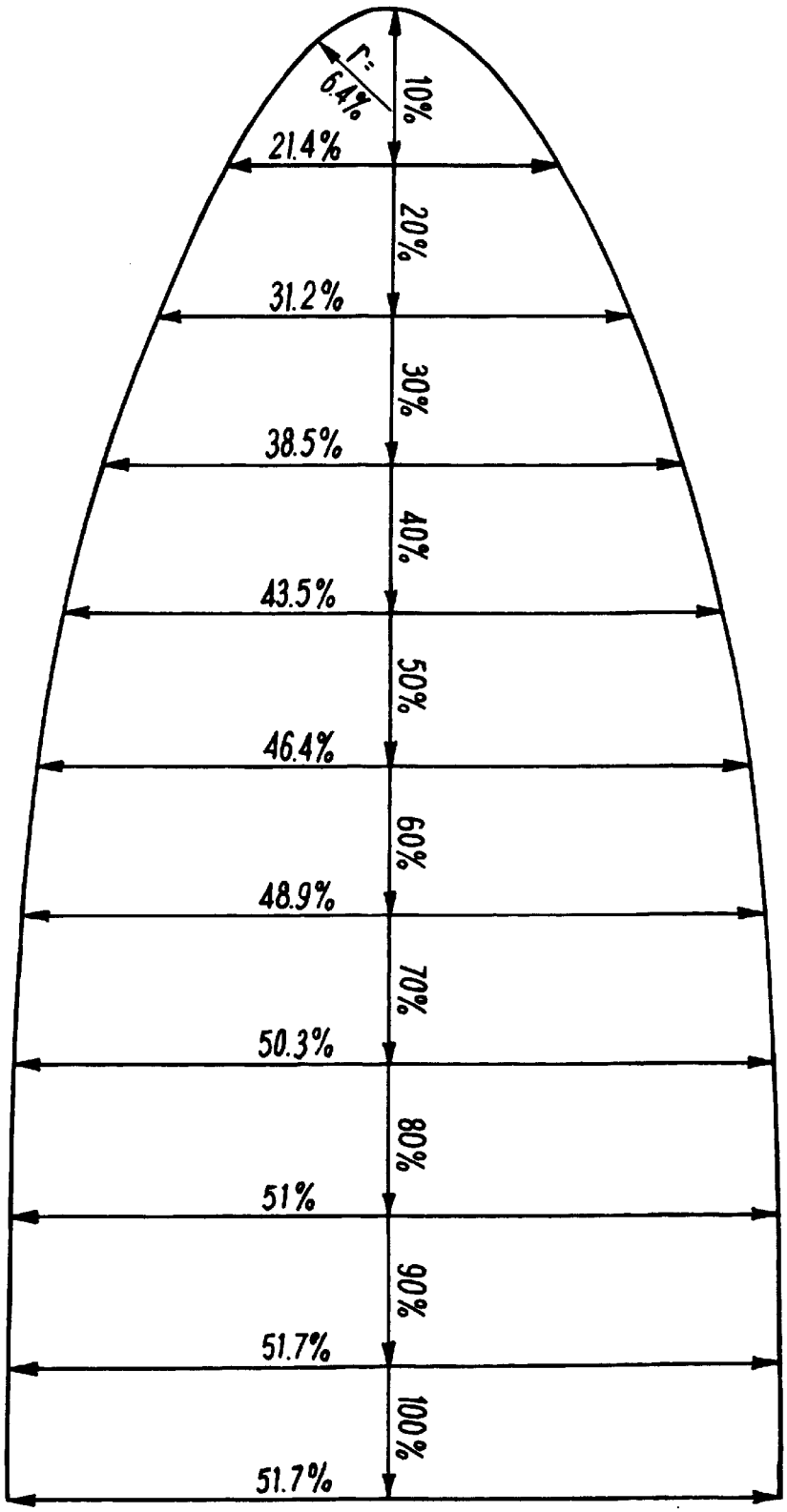
FIG. 4 illustrates possible relative dimensions of the outer edges of a profile in accordance with the invention.

FIG. 4 provides example relative dimensions of the outer edge of a profile in accordance with the invention. The maximum width of the profile is not more than ten per cent of the sail chord at each profile location in the sail. This gives the complete sail a drag co-efficient which is always less than that of a conventional single surface of similar projected area, thus increasing the net propulsive force to a level which always exceeds that of the single surface sail.

Figure 5A:
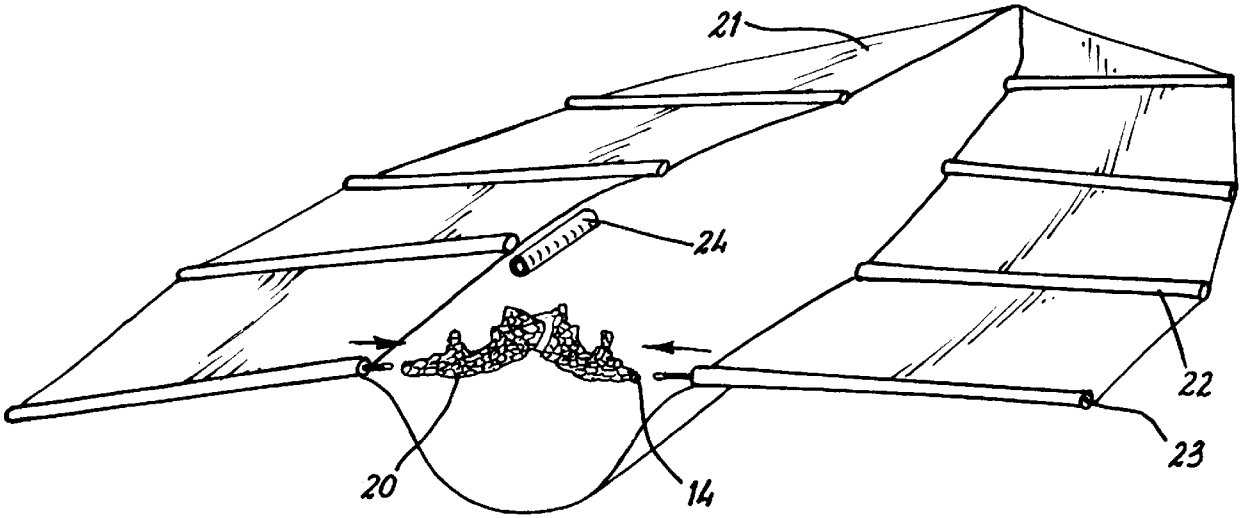
FIGS. 5*a* and 5*b* are illustrations of a profile being used in the assembly of a sail.
Figure 5B:
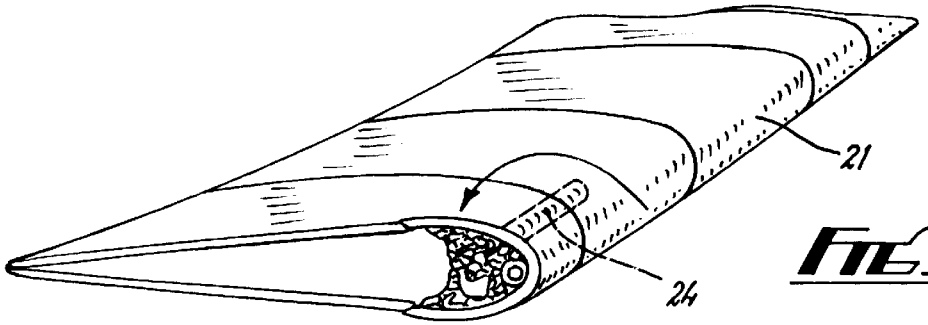

A profile in accordance with the invention is preferably designed to assist in the rigging of a sail. It is recognised that sail rigging is often required in cold or adverse conditions and without the use of tools. A two step diagram of a method of rigging a double surface sail is shown in FIGS. 5*a* and 5*b*. Initially, the sail 21 is laid flat with its inside surfaces upward. The battens 22 are then located, typically held in batten pockets 23 at the leech of the sail 21. Each profile 20 is opened, as shown in FIG. 5*a*, into an extended position and the battens 22 are then inserted into the bores 14.

The profiles 20, battens 22 and sail 21 is then folded around the mast 24 to form a sail envelope having two spaced external sail surfaces.

The invention therefore provides a means, described herein as a profile, that enables a sail to change cross-sectional shape in both the chordwise plane and spanwise or longitudinal plane so that the sail tension in both windward and leeward surfaces is approximately equal in all sailing conditions. In use the profiles and battens provide an initial symmetrical aerofoil shape to the sail, which may deform when loaded to form a variety of intermediate asymmetrical aerofoils, depending upon the angle of attack and wind-speed. This is achieved by virtue of the profiles sliding sideways or rotating until in contact with the mast's windward surface, after which the pressure of air on the sail, battens and profiles produces a propulsive force with a high net value, due to the lowered drag co-efficient inherent in the new aerofoil section.

Additionally, the invention enables smoother shape changing of a sail than previously known, particularly when tacking, mitigating flapping or luffing.

Further modifications and improvements may be incorporated without departing from the scope of the invention intended herein.

What is claimed is:

1. A sail having a mast or spar and two spaced external sail surfaces forming a sail envelope, the mast or spar being positioned substantially within the sail envelope, the sail surfaces being held away from contact from the mast or spar by one or more profiles, and the profiles being shaped in the form of an airfoil, wherein the one or more profiles are free to rotate relative to a longitudinal axis of the mast or spar.

2. A sail as claimed in claim 1, wherein the one or more profiles support the sail surfaces in an airfoil shape.

3. The sail as claimed in claim 1, wherein the one or more profiles each comprise two moulded plastic components hinged together at a pivot or joint positioned forward of the mast or spar.

4. The sail as claimed in claim 3 wherein each component is of substantially identical design and dimension.

5. The sail as claimed in claim 1, wherein an outer edge of the one or more profiles is flanged to provide greater support to inner sides of the external sail surfaces.

* * * * *